US010612381B2

(12) United States Patent
Sicilian et al.

(10) Patent No.: US 10,612,381 B2
(45) Date of Patent: Apr. 7, 2020

(54) MUD MOTOR INVERSE POWER SECTION

(71) Applicant: REME TECHNOLOGIES, LLC, Conroe, TX (US)

(72) Inventors: Joshua Alan Sicilian, Houston, TX (US); Faraz Ali, Friendswood, TX (US)

(73) Assignee: Reme Technologies, LLC, Conroe, TX (US)

( * ) Notice: Subject to any disclaimer, the term of this patent is extended or adjusted under 35 U.S.C. 154(b) by 186 days.

(21) Appl. No.: 15/608,792

(22) Filed: May 30, 2017

(65) Prior Publication Data

US 2018/0347361 A1 Dec. 6, 2018

(51) Int. Cl.

| | |
|---|---|
| ***F03C 2/08*** | (2006.01) |
| ***F04C 15/00*** | (2006.01) |
| ***F04C 13/00*** | (2006.01) |
| ***F04C 2/107*** | (2006.01) |
| ***F01C 1/10*** | (2006.01) |

(52) U.S. Cl.

CPC ..... *F01C 1/101* (2013.01); *F03C 2/08* (2013.01); *F04C 2/1075* (2013.01); *F04C 13/008* (2013.01); *F04C 15/0015* (2013.01); *F05C 2225/12* (2013.01)

(58) Field of Classification Search

None

See application file for complete search history.

(56) References Cited

U.S. PATENT DOCUMENTS

| | | | |
|---|---|---|---|
| 1,892,217 | A | 12/1932 | Moineau |
| 4,104,009 | A | 8/1978 | Chanton |
| 4,187,061 | A | 2/1980 | Jurgens |
| 4,415,316 | A | 11/1983 | Jurgens |
| 4,614,232 | A | 9/1986 | Jurgens et al. |
| 4,676,725 | A | 6/1987 | Eppink |
| 4,718,824 | A | 1/1988 | Cholet et al. |
| 5,145,138 | A | 9/1992 | Schlanger et al. |
| 5,171,138 | A | 12/1992 | Forrest |
| 5,358,390 | A | 10/1994 | Jager |
| 5,759,019 | A | 6/1998 | Wood et al. |
| 6,035,899 | A | 3/2000 | Ohkoshi et al. |
| 6,183,226 | B1 | 2/2001 | Wood et al. |

(Continued)

FOREIGN PATENT DOCUMENTS

| | | |
|---|---|---|
| WO | 2011058294 | 9/2011 |
| WO | 2015126955 A2 | 8/2015 |

OTHER PUBLICATIONS

International Search Report and Written Opinion on corresponding International application No. PCT/US2018/034639, 18 pages, dated Sep. 19, 2018.

*Primary Examiner* — Jeffry H Aftergut

(74) *Attorney, Agent, or Firm* — Patterson Intellectual Property Law, P.C.; William E. Sekyi

(57) ABSTRACT

A progressive cavity positive displacement motor having a solid metal stator and a rotor having an elastomeric seal layer on its outer surface, as well as a method of manufacturing the motor. The elastomeric seal layer on the rotor can be formed by extruding the uncured elastomer, applying the extrusion to the metal rotor core and machining the cured elastomer to produce a uniform thickness seal layer. The elastomer can be made from a high molecular weight elastomer compound. Graphene additives can further enhance the performance characteristics of the elastomer.

11 Claims, 5 Drawing Sheets

(56) References Cited

U.S. PATENT DOCUMENTS

| | | | | |
|---|---|---|---|---|
| 6,279,670 | B1 | 8/2001 | Eddison et al. | |
| 6,309,195 | B1 | 10/2001 | Bottos et al. | |
| 6,413,407 | B1 | 7/2002 | Bruns et al. | |
| 6,461,128 | B1 | 10/2002 | Wood | |
| 6,604,922 | B1 * | 8/2003 | Hache | B29C 70/086 418/153 |
| 8,444,901 | B2 | 5/2013 | Sindt et al. | |
| 8,602,113 | B2 | 12/2013 | Jin et al. | |
| 8,777,598 | B2 | 7/2014 | Akbari et al. | |
| 8,888,474 | B2 | 11/2014 | Hohl et al. | |
| 9,168,552 | B2 | 10/2015 | Symonds | |
| 9,309,884 | B2 | 4/2016 | Akbari | |
| 9,340,854 | B2 | 5/2016 | Scott et al. | |
| 9,441,627 | B2 | 9/2016 | Kitching | |
| 9,482,223 | B2 | 11/2016 | Jarvis et al. | |
| 2002/0084029 | A1 * | 7/2002 | Turner | B29C 45/14491 156/307.7 |
| 2005/0089429 | A1 * | 4/2005 | Delpassand | F04C 2/1075 418/48 |
| 2006/0216178 | A1 | 9/2006 | Sindt et al. | |
| 2007/0140883 | A1 | 6/2007 | Lievestro et al. | |
| 2008/0304992 | A1 | 12/2008 | Hooper et al. | |
| 2009/0016893 | A1 | 1/2009 | Lee et al. | |
| 2009/0152009 | A1 | 6/2009 | Slay et al. | |
| 2010/0038142 | A1 | 2/2010 | Snyder et al. | |
| 2012/0134861 | A1 * | 5/2012 | Akbari | B29C 45/1459 418/48 |
| 2013/0000986 | A1 | 1/2013 | Dick | |

* cited by examiner

MUD MOTOR INVERSE POWER SECTION

FIELD OF THE INVENTION

The present invention relates generally to a progressive cavity positive displacement motor. More particularly, this invention pertains to the power section of a downhole drilling motor.

BACKGROUND OF THE INVENTION

Moineau pump-type progressive cavity displacement motors have been used in oil and gas well drilling operations for some time. In these downhole drilling operations, drilling rig pumps pump drilling fluids, such as drilling mud, downwards through drill pipe to progressive cavity motors located downhole near the end of the drill string. Commonly, a progressive cavity displacement motor is part of a drilling assembly and serves as a drilling or mud motor that drives a drill bit which bores a hole through the underground formation. The pumped drilling fluid powers the mud motor by spinning a rotor within a stator assembly. The rotor and stator constitute the power section of the mud motor.

Typically, progressive cavity displacement motors are configured with helical metal lobed rotors that turn within elastomeric stators. Stators typically consist of rubber with high carbon black filler content. The high carbon black rubber provides a suitable yet cost efficient material having some compressive modulus and abrasion resistance properties. As the metal lobes of the rotors press against the elastomeric stator inner walls, a sealing line is formed and fluid is thus pumped through the cavities as they are formed between the metal lobes of the rotors and the elastomeric stator inner walls.

Usually, the stator is manufactured by attaching a mold to the inner bore of the stator tube and injection molding an uncured elastomer compound into the mold cavity. A challenge to producing a high power, high torque, and high speed power section stator, is that manufacturing equipment and cost effective tooling materials require a low viscosity uncured elastomer compound that is capable of flowing through a tight mold cavity over a long distance while maintaining its uncured state. If the compound is too viscous it cannot flow the appropriate distance along the length of the stator to fill the mold. If a compound begins the vulcanization reaction before the mold is filled, the compound will increase in viscosity, possibly resulting with a mold that is not filled, or a mold that will fill with cross-links that cluster in separate matrices. Separately formed matrices create undetectable grain boundaries in the elastomer product which will often fail prematurely due to significant losses in tear resistance, losses in modulus, and or friction points internally that facilitate rapid physical deterioration of the surrounding elastomer matrix. Traditionally, designers of power section elastomers have sought to address these issues using reinforcing and semi-reinforcing carbon blacks, low viscosity low molecular weight base NBR and HNBR polymers, and process aids in the recipe. Although such combinations are favorable for manufacturability, the resulting recipe negatively impacts the final cured state properties of the elastomer, often making the formulation softer and less dynamically stable. For example, plasticizer oil may be used to decrease viscosity during manufacturing but, in the finished product, it has a tendency to leach out of the elastomer at high temperatures when exposed to diverse drilling fluids, which can cause shrinkage in the product or de-bonding of the rubber to metal bonding agents, and also facilitate the absorption of chemicals from drilling fluid. Plasticizers are used to reduce the viscosity of an uncured rubber compound by lubricating between the polymer chains and aiding in the dispersion of carbon blacks. Once in cured state, plasticizers continue to lubricate the polymer chains creating an effect of lowered modulus. Additionally, plasticizers, being significantly lower molecular weight than polymers, can migrate out of a compound. Controlling the migration of plasticizers is a function of choosing a plasticizer with the right molecular mass/branching and carbon-to-oxygen ratio for a particular compound. The more branching a plasticizer has, the more resistant the plasticizer is to fluid extraction in oils. The potential to react an ester-based plasticizer into the polymer matrix will substantially increase the resistance to extraction.

Elastomeric compounds have seen the incorporation of phenolic resins which reduces the uncured viscosity of the compound and increases the hardness of the cured state product. But this is generally at the cost of reduced tear resistance. Elastomeric compounds have also seen some use of nanoparticles; however, due to the extraordinary surface area to particle volume (i.e. aspect ratio), these compounds can greatly increase the viscosity of the elastomer with only small amounts of additive nanoparticles. This means their potential in power sections stator compounds requires such low loadings (to maintain manufacturability) that the cured state physical properties are not attainable at an affordable, reproducible level of satisfaction.

Further, though the helical metal rotors of progressive cavity motors are heat tolerant, abrasion resistant, and have generally long useful lives, the stators of progressive cavity motors are far less reliable and often fail, need servicing, or replacement before their rotor counterparts. The carbon black reinforced liner of stators tends to wear down when exposed to abrasive materials, can develop leaks between cavities. When exposed to harsh temperatures a rubber compound will soften and can result in seal lines being less capable of handling high differential pressure which can result in a loss in torque. High temperatures can also cause the rubber/elastomer in a liner to thermally expand and thermally soften, which can lead to overheating. Long term exposure to such conditions can cause the rubber to become brittle and lead to low tear resistance. Failures can occur in the form of a section worn down by abrasion leaking and not providing proper sealing pressure against the metal rotor lobes; a physical tear of the inner lining can also occur and cause an immediate shutdown of the entire system. For example, when the stator fails, the rotor can pump torn rubber pieces through cavities and damage other components of the downhole assembly or stop rotating all together. Exposure to certain chemicals or downhole fluids can additionally cause degradation of the stator inner walls. Harsh drilling fluids can be absorbed into the rubber liner, causing swelling which leads to the rubber liner overheating in operation. Fluids can also extract chemicals from the rubber, thereby degrading it.

The power output, efficiency and torque of progressive cavity positive displacement motors is related to the cross sectional area of the stator and rotor that is available for fluid flow, as well as the ability of the rotor and stator to seal against one another and prevent the pressurized fluid from leaking out into low pressure areas of the motor. Because of dimensional limitations of the wellbore, and the structural and functional requirements of the stator and rotor, the flow cross sectional area can be limited. Also, strength limitations and local failures in elastomer integrity can allow drilling fluid leaks at moderate pressure differentials. Accordingly, such a motor may be limited to generating only moderate torque output. If the torque that the motor must overcome exceeds the torque the motor can produce, the motor may stall, rupturing the power section seals and causing severe damage to the power section stator.

It would thus be desirable to have a more robust progressive cavity positive displacement motor with increased power output, efficiency and torque output, as well as improved heat tolerance, abrasion resistance, tear resistance, and other beneficial properties. Further, it would be desirable to provide increased meantime between failures, increased reliability, and an expectation of extended runtime for operations running elastomeric stator assemblies downhole. This would allow greater drilling time and decreased time spent installing, retrieving, and servicing elastomeric stator assemblies and other components of the associated downhole assemblies that can fail as the result of a stator failure. It would further be desirable to increase the predicted time interval between required servicing of elastomeric stator assemblies.

BRIEF SUMMARY OF THE INVENTION

The present invention provides various embodiments that can address and improve upon some of the deficiencies of the prior art. One embodiment, for example, provides a mud motor having a mud motor power section, which includes a stator with a longitudinal axis, a passage along the longitudinal axis and a set of stator lobes forming a stator inner surface that surrounds the passage. The mud motor power section also includes a rotor disposed within the passage, the rotor having a set of rotor lobes formed on an outer surface of the rotor facing the stator inner surface, the outer surface having a high molecular weight thermoset elastomeric seal layer.

In a first option, the high molecular weight thermoset elastomeric seal layer is formed from an uncured elastomer having a viscosity of more than 55 Mooney units at 212° F. According to a second option, the high molecular weight thermoset elastomeric coating can be a polyaryl polymer. According to one aspect, the high molecular weight thermoset elastomeric coating can be a polyaryl polymer including PAEK, PEK, PEEK, PEKEK, or PEKEKK and combinations thereof. Alternatively, the high molecular weight thermoset elastomeric coating can be a nitrile polymer. In a more specific aspect, the high molecular weight thermoset elastomeric coating can be a nitrile polymer including NBR, HNBR, XNBR or HXNBR and combinations thereof.

In a third option of this embodiment, the high molecular weight thermoset elastomeric seal layer can further include graphene particles and rubber. According to one aspect of this option, the graphene particles are functionalized graphene particles having a single mono-carbon layer sheet thickness. According to another aspect, the graphene particles are functionalized graphene particles having a 2-30 mono-carbon layer sheet thickness.

According to some aspects of these embodiments, the high molecular weight thermoset elastomeric coating can be made from a nitrile butadiene or similar elastomer or polyaryl polymer having a uniaxial tension stress of at least 100 psi at a strain of 0.075 in/in or a planar shear stress of at least 180 psi at a strain of 0.075 in/in a uniaxial compression stress of at least 140 psi at a strain of 0.075 in/in and combinations of these properties.

According to a fourth option of the embodiment, the stator can be a ferrous metal and the stator inner surface can include a coating of a pure metal, a metal alloy, a carbide or a metal oxide. The coating can be a tungsten carbide coating.

A second embodiment provides a method of manufacturing a mud motor that includes providing an intermediate assembly having a mud motor rotor core. The rotor core includes a contoured surface defining a set of rotor lobes extending along a length of the rotor core, the set of rotor lobes formed by helical lobe crests separated from each other by helical lobe valleys. The method can further include wrapping a length of an uncured first high molecular weight elastomer in a helical pattern around the intermediate assembly to cover an intermediate assembly outer surface and form a rotor core final assembly, curing the high molecular weight elastomer in the final assembly, and machining the cured high molecular weight elastomer in the final assembly to form an uniform cured elastomer coating/layer/liner.

Providing an intermediate assembly according to this embodiment can further include winding a length of an uncured second high molecular weight elastomer extrusion in each helical lobe valley to form a substantially cylindrical outer surface, prior to wrapping the length of an uncured first high molecular weight elastomer on the intermediate assembly outer surface.

According to a one option, the rotor core can include a longitudinal bore, and the embodiment can further include curing the first and second high molecular weight elastomer and passing a heated fluid through the bore. The heated fluid can be steam or glycol or a thermally stable oil.

According to a second option, the rotor core final assembly can include a final assembly outer surface, and the curing step can further include encasing the final assembly outer surface with a wetted nylon web and heating the encased final assembly in an autoclave to cure the first and second high molecular weight elastomer.

In one aspect, curing can include heating uncured first and second high molecular weight elastomers to at least 275° F., or at least 300° F. In another aspect, curing can include heating the final rotor assembly to at least 275° F. in a chamber. Optionally, the rotor core can include a longitudinal bore, and curing the first and second high molecular weight elastomer can include passing a heated fluid through the bore. Optionally, the rotor core can include a longitudinal bore, and curing the first and second high molecular weight elastomer can include inserting an electric heating coil element or electromagnetic induction element into the rotor core's longitudinal bore.

DETAILED DESCRIPTION OF THE INVENTION

Figure 1:
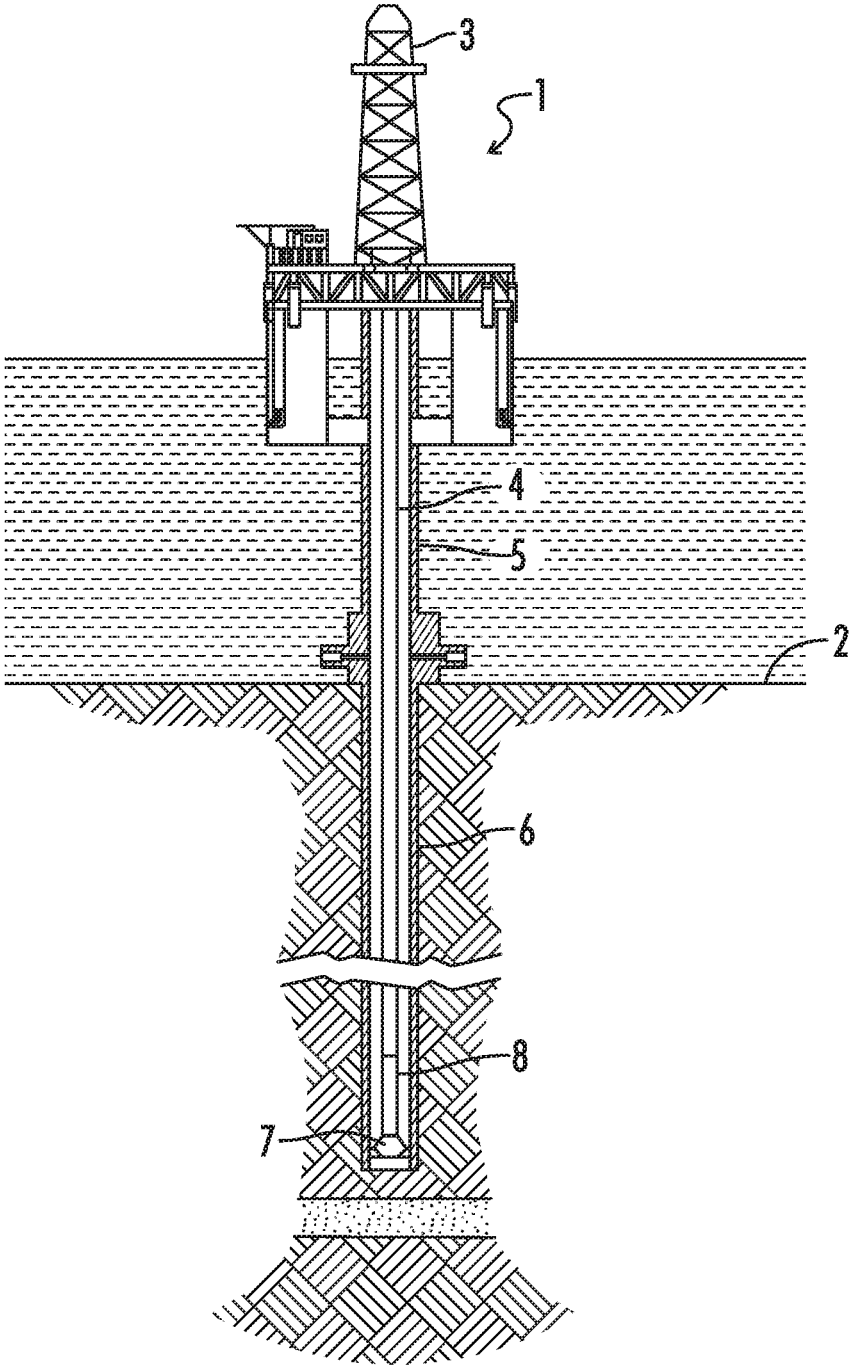
FIG. 1 is a schematic illustration of an offshore drilling rig drilling a well into a ground formation.

Embodiments of downhole drilling motors of the present invention can be used to drill wellbores into a ground formation. FIG. 1 is an illustration of a drill string 4 connected to a floating offshore drilling rig 3 which uses drill string 4 to drill a wellbore 6 into a ground formation 2. Subsea risers and well control equipment 5 connect the floating drilling rig 3 to the wellbore 6 in the ground formation 2. A bottom hole assembly 8 is attached to the bottom of drill string 4 and includes drill bit 7 that rotates under a downward axial force produced by the weight of the drill string that drilling rig 3 permits to sit on drill bit 7. In addition, drilling rig 3 pumps drilling fluid, also known as drilling mud, through the center passages of the drill pipe that makes up the upper portions of drill string 4. The flow of drilling mud can be used to power various valves and tools in the drill string including drilling assembly 8. While FIG. 1 depicts an offshore drilling rig it will be understood that land based drilling rigs can also use the technology of the present invention.

Figure 2:
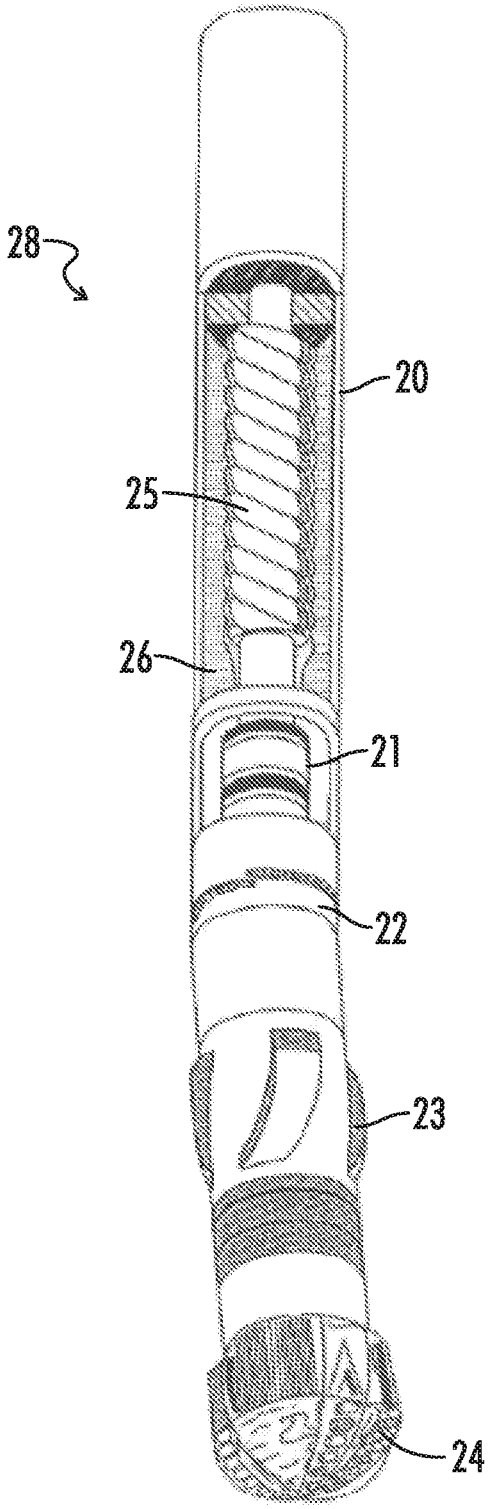
FIG. 2 is a schematic view of a downhole drilling assembly according to one embodiment of the present invention.

FIG. 2 illustrates a bottom hole drilling assembly 28 that may be used to drill a well, such as an oil or gas well, into a ground formation. Bottom hole drilling assembly 28 can include a mud motor power section 20 a universal joint section 21, a bearing section 23 and a drill bit 24. Power section 20 is generally cylindrical and has a stator 26 cylindrically arranged around a central axis. Power section 20 includes a rotor 25 positioned within a central passageway or bore. The bore extends along the central axis through stator 26. When fluid, such as drilling mud, flows through the stator bore, it is forced through a sequence of discrete cavities that are formed between the mating surfaces of rotor 25 and stator 26. Under pressure, the fluid flow through the cavities causes rotor 25 to eccentrically rotate in the stator bore.

Transmission section 21 below power section 20 can receive the eccentric rotation of rotor 25 and produce a concentric rotation transmitted to drill bit 24. Transmission section 21 can include, for example, a shaft connected at one end to rotor 25 by a universal joint coupling, and connected, at its other end, via universal joints to drill bit 24. Adjustable assembly 22 allows the lower sections of the drilling assembly to bend and adjusts the angle of the lower portions relative to the upper portions, thereby steering the drill string. Bearing section 23 retains rotor 25 in power section 20 against the flow of drilling mud. It also enables drill bit 24 to rotate relative to power section 20, while transmitting axial loads from the drill string above that are needed to move the drill string and penetrate underground formations.

Figure 3:
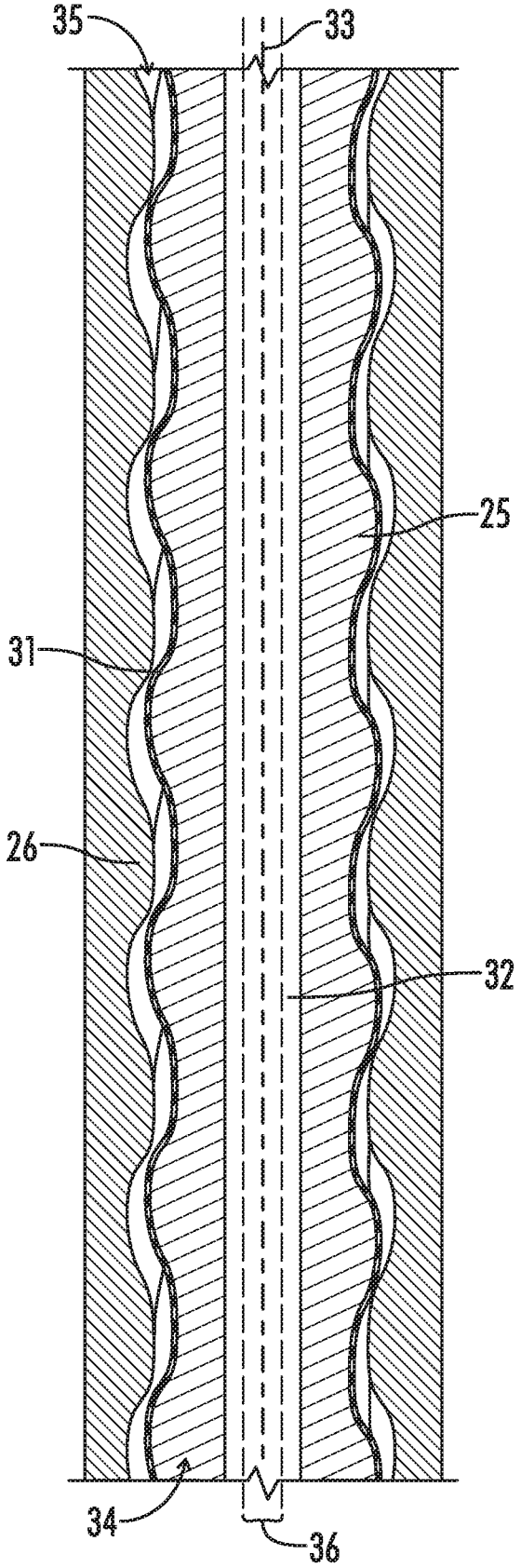
FIG. 3 is a cross longitudinal sectional view of a mud motor power section according to one embodiment of the present invention.

FIG. 3 is a longitudinal cross sectional view of a length of power section 20, according to one embodiment. Stator 26 can have a generally cylindrical external surface centered on center line 33. The stator body can be formed from a metal, preferably a ferrous metal or alloy. Passageway or bore 32 of stator 26 can be concentrically arranged around center line 33. As a part of the drill string, stator 26 should be designed to withstand the axial, radial and torsional loads it will be subjected to in service as, for example, the drilling assembly is lowered into the well, drills through subsurface formations, and subsequently returned to the surface. Accordingly, the sidewalls of stator 26 are designed to be sufficiently thick and rigid to prevent power section 20 from buckling, excessive flexing or otherwise deforming under expected service loads.

As shown in FIG. 3, power section 20 can also include rotor 25 which can also be formed from a metal, such as a ferrous metal or alloy. Rotor 25 can include a rotor bore or passageway 32 that extends longitudinally along a central axis of rotor core 34. Rotor 25, however, is located eccentrically with respect to stator 26. Center line 33 of stator 26 does not coincide with the centerline of rotor 25, as can best be seen in FIG. 4. In operation, rotor 25 rotates eccentrically around the stator passageway so that the center line of rotor 25 generally moves within limits 36 in FIG. 3. While the internal surfaces of stator 26 that surround stator bore 32 are preferably a resilient metallic surface, such as a ferrous metal or alloy with a hardened surface layer or coating, rotor 25 includes a metal rotor core 34 surrounded by a resilient and tough rotor elastomeric seal layer 31. The metal core 34 can be a ferrous metal or alloy.

Figure 4:
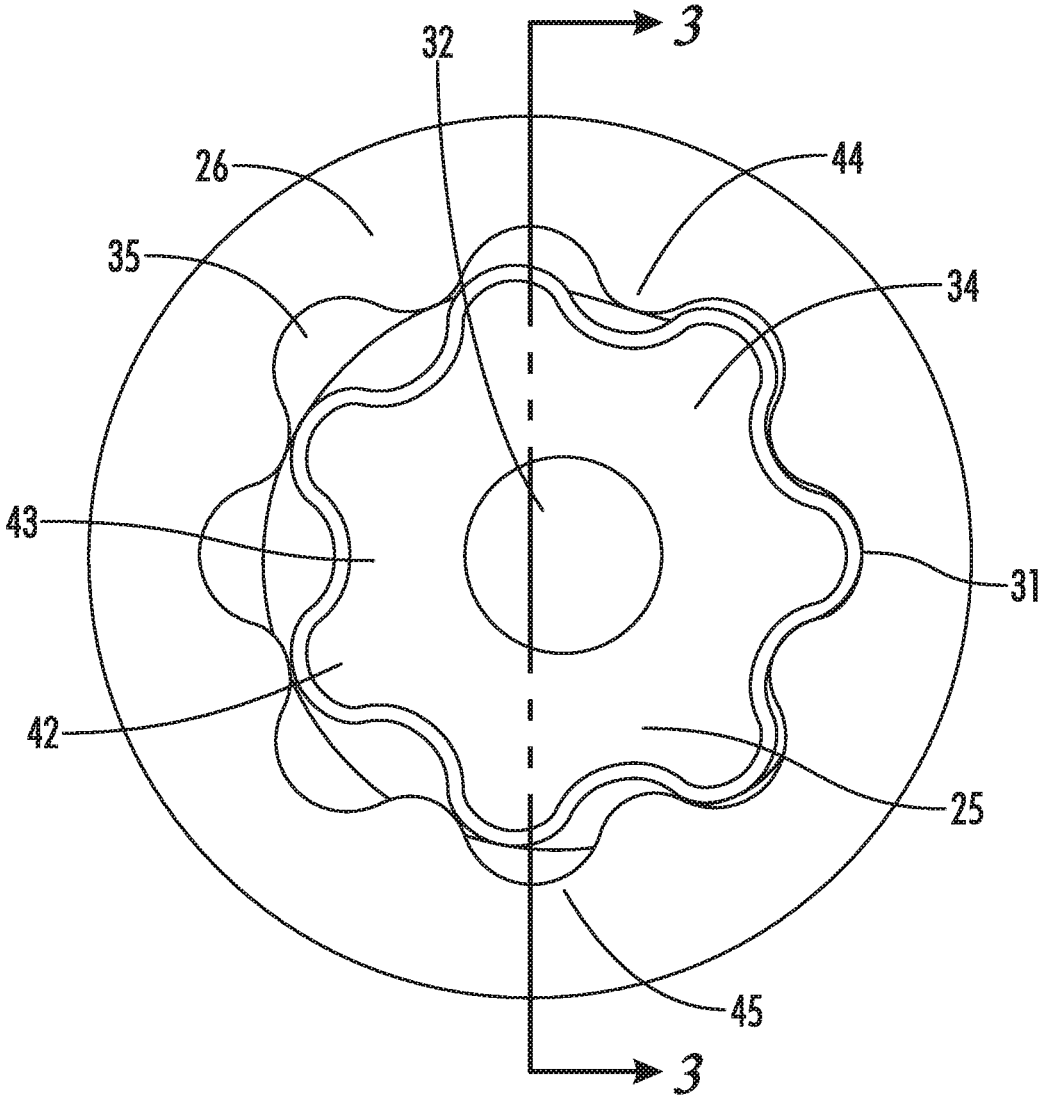
FIG. 4 is an end view of a mud motor power section stator and rotor according to one embodiment of the present invention.

FIG. 4, which is an end view of one embodiment of stator 26 and rotor 25 of power section 20, shows that the inner surface of stator 26 defines a set of lobes formed by ridges or crests 44 separated from each other by troughs 45. Similarly, in this embodiment, rotor core 34 of rotor 25 defines a set of lobes formed by ridges or crests 42 separated from each other by troughs or valleys 43. Elastomeric seal layer 31 is essentially of uniform thickness, within machining tolerances, and follows the profile of the underlying rotor core 34. Thus the surface of rotor 25 formed by exterior surface of elastomeric seal layer also defines a set of lobes. The number of stator and rotor lobes can vary depending on mud motor design. Thus, although the embodiment shown in FIG. 4 includes 7 rotor lobes and 8 stator lobes, the specific number of lobes shown is not intended to limit the scope or intent of the present invention. However, as will be understood by those of ordinary skill, in progressive cavity positive displacement motors, the number of stator lobes should be greater than the number or rotor lobes by 1. Rotor 25 can also include bore 32 that is concentric and extends along the center line of rotor body 34. Rotor bore 32 not only reduces the weight of rotor 25, but can also serve as a fluid passage during the mud motor manufacturing process, as will be described. Optionally, rotor 25 can be configured with appropriate ports, valves and control hardware to divert excess drilling fluid through rotor bore 32 and down to the drill bit during drilling operations to facilitate washing drill bit cuttings up the wellbore annulus.

As will be more clearly apparent from FIG. 4, the crests 42 and troughs 43 of rotor core 34, and thus the lobes of rotor 25, are arranged helically around the rotor core 34. The lobes of stator 26 are similarly arranged along the stator length. The length, dimensions and cross sectional shape of the lobes can vary according to mud motor design. As the rotor turns, the lobes of rotor 25 engage at different points along their length with the lobes of stator 26, creating cavities 35 into which drilling mud flows under pressure during drilling operations. The differential fluid pressure between the interior and exterior of these cavities 35 produces torque in the rotor 25. As rotor 25 turns in the stator under the force exerted by the fluid, cavities 35 move and progress along the length of the power section.

Typically, during operation, rotor and stator mating surfaces recurrently engage and disengage as rotor 25 turns, to dynamically form cavities 35 with edges sealed against the pressure of drilling mud pumped through stator 26. One method of forming effective, reliable seals between the mating surfaces of rotor 25 and stator 26 is by forming elastomeric coating that is strong, tough, and deformable, on one of the mating surfaces.

Generally, the larger total cross sectional area of cavities 35 that is available for fluid flow, the greater the power the power section 20 can produce. Given a particular rotor and stator lobe design, the cavity cross sectional area can be increased by increasing the average internal diameter of the stator passageway and controlling the average diameter of rotor 25. Well bore dimensions and structural requirements for stator 26 limit stator external diameter as well as the minimum stator wall thickness. A stator designed for a 8.75 inch diameter well bore, for example, typically has an outer diameter of 6.25-7.25 inches, and an average stator wall thickness of 0.625-1.25 inches. In the embodiments shown in FIGS. 3 and 4, the flow cross-sectional area of cavities 35 is improved by forming a strong, tough and deformable elastomeric coating 31 on the exterior surfaces of rotor core 34, rather than on the interior surfaces of stator 26 that face its central passageway or bore. Thus according to some embodiments of the present invention, the design of power section 20 is the reverse, or inverse, of conventional designs.

The formulation of the elastomer in elastomeric seal layer 31 can also have a major impact on the performance of power section 20. To form a reliable seal against lobes of stator 26, the elastomer of elastomeric seal layer 31 should deform sufficiently to follow the curvature, undulations or imperfections in the corresponding stator surface on which it seals, thus presenting a barrier to fluid flow across the seal. The elastomer should also have sufficient modulus, or strength to prevent the fluid pressure from displacing the deformed elastomer away from the mating surface. A cavity between rotor and stator can only maintain differential pressure and imparted torque efficiently if the stator elastomer is of high enough modulus to not deflect, thus preventing fluid from progressing forward to the subsequent cavity. Fluid slippage between the rotor and stator interface can cause a loss in the volumetric fluid pressure to torque efficiency. The more differential pressure the elastomeric seal layer 31 can sustain, the more torque will be imparted to the rotor 25. In power sections, the flow through is proportional to the eccentric rotating speed of the rotor for any given standard geometry and power section stators can function as a dynamic sealed interface with which the rotor interacts. Not only must an elastomer compound maintain modulus to make the seal, but the visco-elastic dynamic properties must maintain a mostly elastic response over high frequencies in high temperature drilling environments. The ability for a lobe to rebound back is a function of the elastic dynamic decay of the modulus around the frequency of the power section's maximum rated flowrate and differential. The less decay in the elastic response the more differential pressure a power section stator can handle at higher flow rates and the more powerful and reliable the power section is likely to be in challenging drilling environments.

The recurrent flexing and deformation that occurs in the elastomer when rotor 25 turns in stator 26 can cause the elastomer to generate heat through hysteresis, in addition to the heat the mud motor can absorb from its downhole surroundings which can frequently exceed 280° F. and even 360° F. in some wells. Excessive heat can cause the elastomer properties to degrade and lead to failure. Formulating the elastomer to minimize heat generation through hysteresis can, thus also benefit performance and longevity of elastomeric coating 31.

Elastomeric seal layer 31 can advantageously be formulated from a high molecular weight elastomeric polymer such as nitrile rubber including nitrile butadiene rubber (NBR), hydrogenated nitrile butadiene rubber (HNBR), or carboxylated nitrile butadiene rubber (XNBR), as well as HXNBR and combinations of these polymers. Alternatively, or in addition, elastomeric seal layer can be made from a high molecular weight polyaryl elastomeric polymer including polyaryl ether ketone (PAEK), polyether ketone (PEK), polyether ether ketone (PEEK), PEKEK, or PEKEKK and combinations thereof. It will be understood by those skilled in the art that the molecular weights referenced above is of the bulk material, not individual polymer molecules and thus may be considered an average molecular weight of the polymer molecules in the bulk material.

Prior to curing or vulcanization, these high molecular weight polymers can exhibit Mooney viscosities above 55 Mooney units at 212° F. Optionally, elastomeric seal layer 31 can be made from high molecular weight elastomers exhibiting uncured viscosities above 75 Mooney units at 212° F., or even above 100 Mooney units at 212° F. Thus far, manufacturing difficulties have prevented making mud motors using such high molecular weight polymers. The Mooney viscosities of these high molecular weight polymers prevented injection molding them in the long lengths required for mud motor power sections.

Additives may also be added to enhance the physical properties and chemical resistance of the elastomeric polymers used in various embodiments of the present invention. The addition of nano-particles, including carbon nanotubes, graphene particles, nano-clays, bucky balls and other three dimensional engineered carbon structures (reinforcing fillers), that offer large surface-area to weight ratios can be beneficial to reinforcing elastomeric polymers by utilizing the high surface area particles to create an increase in van der Waals attractive forces between the polymer and filler particles. Platelet shaped particles can also influence the chemical resistance of an elastomer, by creating inert barriers that stop the progress of permeating drilling fluid chemicals.

Graphene particles and other nano scale sheets of carbon are not bound together or to one another by the strong interfacial van der Waals forces that are common among graphitic materials. Other nano scale sheets can be substitutes for graphene for certain formulations. Further, and as referenced previously, graphene particles can be chemically altered, with a reactive functional groups covalently bonded to the particles. Functional groups may include phenolic ring structures, sulfur atoms or sulfur chains, organic peroxide groups, formaldehyde functional groups, isocyanates, isocyanurates, tetramethylmethylamine (TMTM), hexamethyl methylamine ("hexa." HMT), and/or fatty acid groups/hydroxl groups.

A graphene enhanced elastomeric stator can be made by dispersing graphene particles or sheets in an uncured rubber compound. In some embodiments, before dispersing the graphene can be sorted to provide mostly, or alternatively, substantially only graphene sheets of optimal size for a given formulation. The sizing of the graphene sheets can be optimized while keeping in mind the later steps of the process that can further break apart or break down some of the graphene particles. More specifically, the graphene particles can be selected to include sheets of mostly, or alternatively, substantially only a single mono-carbon layer thickness. Optionally, the graphene particles can be selected to include sheets of mostly, or alternatively, substantially only 2-30 mono-carbon layer thicknesses. Alternatively, optimizing the tear resistance of a group of compounds with the same graphene concentration and variable graphene particle size can be more cost effective. Chemically etching fracture surfaces of graphene enhanced elastomers can be viewed under an electron microscope to determine particle sizes, particle density, and the level of optimization achieved. Further, in an embodiment, the graphene can be functionalized before dispersion to increase the cross-link density of what will become the graphene enhanced elastomeric stator.

Embodiments of graphene enhanced elastomeric stator compounds having functionalized and/or non-functionalized graphene particles that are dispersed in the elastomeric polymer matrix as described above can be used in power section drilling stators that require exceptional cured state tensile modulus, tear resistance, shear modulus, compressive modulus, elastic dynamic stability, high temperature resistance to polymer chain scission, surface abrasion resistance to the drilling fluid solids and/or rotor metal finish and fluid swelling resistance (when exposed to various water based, oil based, or synthetic oil based drilling fluids, as well as other similar fluids).

On previous mud motors, the elastomeric coating was injection molded onto the interior surface of the stator rather than the external surfaces of the rotor. The lower molecular weight of the elastomeric polymers conventionally used in mud motor power section elastomer layers on the stator or rotor do not achieve the mechanical properties of the elastomers of the embodiments described herein. The high molecular weights and additives of the elastomeric polymer formulations of the embodiments described achieve significant improvements in modulus and strength. For example, these polymers can achieve uniaxial tension stresses of at least 50 psi at a strain of 0.025 in/in and at least 100 psi at a strain of 0.075 in/in, all measured at 240° F. As a further example, these polymers can achieve planar shear stress of at least 78 psi at a strain of 0.025 in/in and at least 180 psi at a strain of 0.075 in/in, all measured at 240° F. As yet another further example, these polymers can achieve a uniaxial compression stress of at least 50 psi at a strain of 0.025 in/in and at least 140 psi at a strain of 0.075 in/in, all measured at 240° F.

Figure 5A:
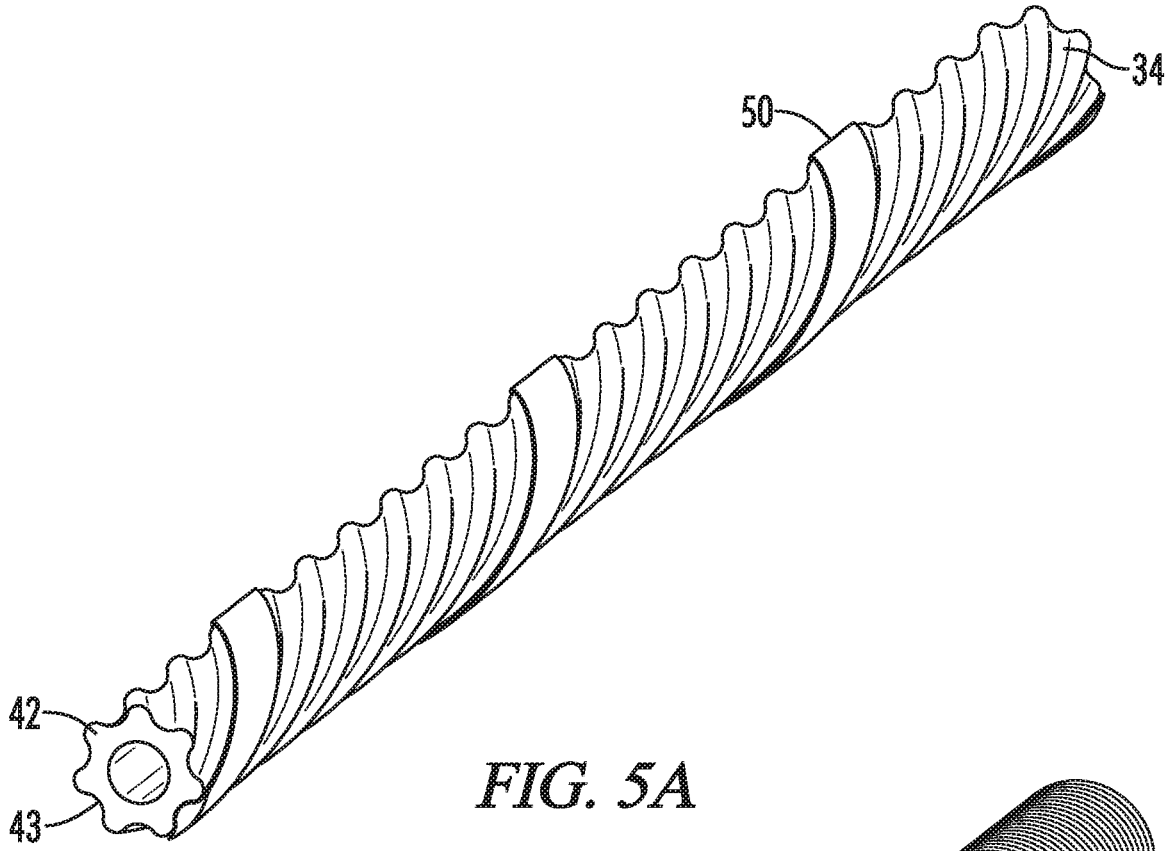
FIG. 5A is an isometric view of a partially manufactured mud motor rotor according to one embodiment of the present invention.

Instead of previous power section manufacturing techniques which required injection molding the power section elastomer layer onto the stator, in various embodiments of the present invention, elastomeric seal layer 31 is advantageously formed on rotor core 34, as described above. Forming elastomeric seal layer 31 on rotor core 34 using manufacturing techniques that avoid injection molding allows the use of high molecular weight elastomeric polymers not previously used in power sections. One manufacturing option is to provide a rotor core 34 made from a cylindrical ferrous metal bar profiled using various machining techniques to produce crests 42 and troughs 43 of a specific helical lobe shape as shown, for example, in FIG. 5A. Basic rotor milling can be performed, for example, by a conventional angled milling wheel on a long bed turning center. Alternatively, the shape of the metal profile can be produced by hobbing, using a complex carbide cylindrical cutting tool that is rotated a specific angles compared to the turning center's z-axis and advanced along the length of the raw tube or bar stock material. Once rotor core 34 is formed by this process, further surface polishing may be unnecessary. Rotor core 34 can then be chemically cleaned of machining fluid, and then grit-blasted to produce approximately a 300 Ra white metal surface finish. The rotor core surface can then be wiped with a cleaner or solvent to remove dust before a primer coat is sprayed using an atomization sprayer that causes high pressure air to impinge upon a steady stream of liquid primer. Upon drying, one or more adhesive coat(s) can be applied via atomization spray.

Figure 5B:
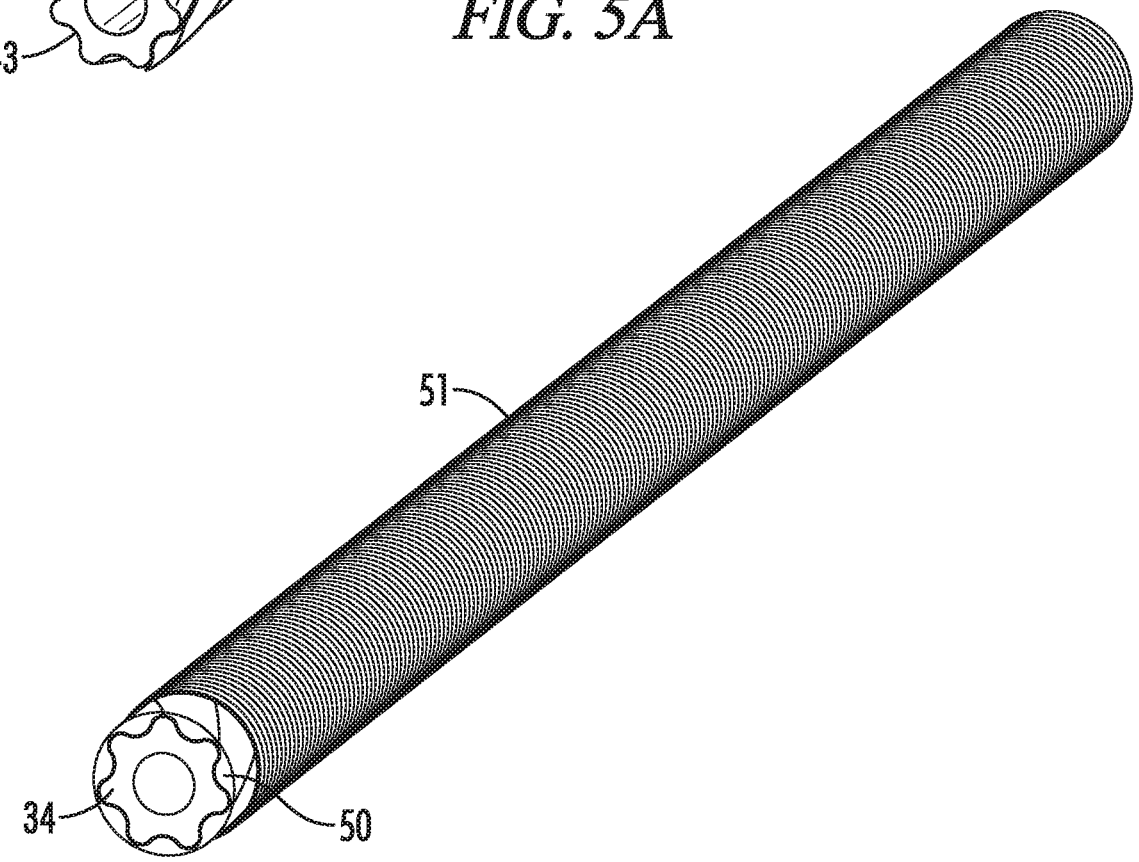
FIG. 5B is an isometric view of the mud motor rotor of FIG. 5A after further manufacturing according to one embodiment of the present invention.

Once rotor core 34 is prepared, an elastomer layer can be built up on its surface as follows. The adhesive coated rotor core 34 can then be placed on a turning center and an elastomer extruder aligned with the helix of trough 43. Raw (not cured or vulcanized) elastomer can be extruded through the extruder, removing air and masticating the material before exiting through a die or series of dies to form extrusion ribbon or strip 50. The extrusion strip 50 is preferably shaped by the extruder to form a complementary shape to the lobe profile of rotor core 34, so as to fill the space between adjacent crests 42 with extrusion strip 50 and form a circular arc on the outer surface strip 50. This process can be repeated so that all helical troughs 43 are filled and the outer surfaces of all the extrusion strips 50 on rotor core 34 form a substantially cylindrical surface. A second layer of raw elastomer extrusion strips 51 can be wrapped over the substantially cylindrical surface formed by extrusion strips 50. Extrusion strips can be rectangular in cross section and can be wound in a tight helix so that the adjacent turns of the helix formed by strip 51 touch, forming a continuous second cylindrical elastomer surface as shown in FIG. 5B. Any voids caused by imperfections or undulations in the substantially cylindrical surface of extrusion strips 50 are preferably filled with elastomer of strip 51. Strips 51 can be wrapped under tension around the surface of strips 50 to facilitate filling these minor voids.

Optionally the cylindrical surface of strip 51 can be tightly wrapped with a wet web of nylon under tension. The heat of the curing process can cause the wet nylon web to contract thereby exerting additional compressive force, assisting to consolidate the elastomer layer. In an alternative process, application of extrusion strips 50 to rotor core 34 can be omitted, and strip 51 wrapped directly onto rotor core 34. Rollers, followers or similar devices may be used as strip 51 is wrapped to ensure that strip 51 properly adheres to the troughs 43 and crests 42 of rotor core 43 to create a void-free elastomer layer. The assembly of rotor core 34 and raw elastomer strips 50 and 51 can be cured by heating the assembly to its curing temperature, which can be above 275° F. or, in some cases, above 300° F. Heating can be achieved by placing the assembly in a chamber, such as an oven or autoclave, and heating appropriately. Alternatively, heating can be achieved by passing a suitable heated fluid, such as steam or glycol or thermally stable oil through bore 32 of rotor core 34. Alternatively, electric heating coil element(s) or electromagnetic induction coil element can provide the heating source in bore 32 of rotor core 34.

Once cured and cooled, the rotor cylinder assembly can be mounted on a lathe and turned to a constant diameter that is equal to or larger than the major diameter of the finished good. Then, using a milling or hobbing technique already described, a parallel rotor profile can be machined into the surface of the rotor cylinder assembly, leaving behind a rotor with an even, or uniform thickness layer, of elastomer which forms elastomeric seal layer 31 on the rotor core 34.

Optionally, prior to machining and/or hobbing, the elastomer can cooled to within about 40° F. of the elastomers' glass transition temperature by passing liquid or cooled gaseous nitrogen through rotor bore 32, which may significantly improve the surface finish of the machining process. As a further option, the surface of elastomeric seal layer 31 can be polished using a computer numerically controlled sanding belt on a multi axis turning center. In yet a further option, the finished rotor 25 can be heated in an oven for post curing process to improve the physical properties of the elastomer.

The profile of crests 44 and troughs 45 of the lobes of stator 26 can be formed by known machining process. For example, a desired profile can be produced by high tolerance milling of a thick-walled metal tube, with milling tools centralized on a constant diameter and straight bore using computer numerically controlled (CNC) controls. The milled stator tube can then be polished on a CNC machine that utilizes grinding or sanding belts to remove rough surfaces caused by milling. Alternatively or in addition to this procedure, the surface can be cross-hatched using flexible honing structures and/or the stator tube can be electropolished to clean and further improve the surface finish.

Because elastomeric seal layer 31 is disposed on rotor 25 and not stator 26, the interior surface of stator 26 should preferably be protected from abrasion (wash) and corrosion that could otherwise occur as a result of entrained solids and additives in the drilling mud that flows through the stator passageway. This can be achieved by applying a very thin, wash resistant coating on the interior surfaces of stator 26, such as by chemically curing a polytetrafluoroethylene or similar polymeric material, or applying a chemical vapor deposition (CVD) carbide coating to these surfaces.

After preparatory chemical treatment, stator 26 can be sealed at its ends and a vacuum created in its bore. Stator 26 thus forms a closed, evacuated tube and can then be heated in an oven or by alternative means such as hot coils, or electromagnetic induction coils, to make the stator body an oven to its own inner surface. A carbide vapor, such as tungsten carbide, can be introduced through the ends of the tube and deposits on the stator bore surface thereby forming a durable, smooth carbide coating. In some embodiments, there may be no need for subsequent surface finishing.

Thus, although there have been described particular embodiments of the present invention of a new and useful Patent Search and Opinion it is not intended that such references be construed as limitations upon the scope of this invention except as set forth in the following claims.

What is claimed is:

1. A method of manufacturing a mud motor comprising:

providing an intermediate assembly including a mud motor rotor core, the rotor core having a contoured surface defining a set of rotor lobes extending along a length of the rotor core, the set of rotor lobes formed by helical lobe crests separated from each other by helical lobe valleys, wrapping a length of an uncured first high molecular weight elastomer in a helical pattern around the intermediate assembly to cover an intermediate assembly outer surface and form a rotor core final assembly;

curing the high molecular weight elastomer in the final assembly, wherein the rotor core includes a longitudinal bore, and wherein curing the high molecular weight elastomer includes passing a heated fluid through the bore;

machining the cured high molecular weight elastomer in the final assembly to form a uniform cured elastomeric seal layer.

2. The method of claim 1, wherein the heated fluid is steam.

3. The method of claim 1, wherein the heated fluid is glycol.

4. The method of claim 1, wherein the heated fluid is a thermally stable oil.

5. The method of claim 1, wherein providing an intermediate assembly further includes winding a length of an uncured second high molecular weight elastomer extrusion in each helical lobe valley to form a substantially cylindrical outer surface, prior to wrapping the length of an uncured first high molecular weight elastomer on the intermediate assembly outer surface.

6. The method of claim 5, wherein the rotor core final assembly includes a final assembly outer surface, and wherein curing includes encasing the final assembly outer surface with a wetted nylon web and heating the encased final assembly in an autoclave or oven to cure the first molecular weight elastomer and the second high molecular weight elastomer.

7. The method of claim 5, wherein curing includes heating uncured first and second high molecular weight elastomers to at least 275° F.

8. The method of claim 5, wherein curing includes heating uncured first and second high molecular weight elastomers to at least 300° F.

9. The method of claim 5, wherein curing includes heating the final rotor assembly to at least 275° F. in a chamber.

10. The method of claim 9, wherein the rotor core includes a longitudinal bore, and wherein curing the first and second high molecular weight elastomer includes passing a heated fluid through the bore.

11. The method of claim 5, wherein the rotor core includes a longitudinal bore, and wherein curing the first and second high molecular weight elastomer heating the rotor core using a resistive or inductive electric heating element.

* * * * *